US005546059A

United States Patent [19]

Yorita et al.

[11] Patent Number: 5,546,059

[45] Date of Patent: Aug. 13, 1996

[54] DIELECTRIC FILTER HAVING A NON-CONDUCTIVE REGION IN EACH RESONATOR HOLE

[75] Inventors: Tadahiro Yorita; Yasuo Yamada; Hirohumi Miyamoto, all of Nagaokakyo, Japan

[73] Assignee: Murata Manufacturing Co., Ltd., Japan

[21] Appl. No.: 135,686

[22] Filed: Oct. 13, 1993

[30] Foreign Application Priority Data

Oct. 16, 1992 [JP] Japan ..... 4-72386 U

[51] Int. Cl.[6] ..... H01P 1/201

[52] U.S. Cl. ..... 333/202; 333/206

[58] Field of Search ..... 333/202, 203, 333/206, 207, 222, 223

[56] References Cited

U.S. PATENT DOCUMENTS

| | | | |
|---|---|---|---|
| 4,673,902 | 6/1987 | Takeda et al. | 333/206 X |
| 4,703,291 | 10/1987 | Nishikawa et al. | 333/206 X |
| 5,208,565 | 5/1993 | Sogo et al. | 333/206 |
| 5,293,141 | 3/1994 | Kobayashi et al. | 333/206 |

FOREIGN PATENT DOCUMENTS

| | | | |
|---|---|---|---|
| 0538894 | 4/1993 | European Pat. Off. | 333/202 |
| 62-0040802 | 2/1987 | Japan | 333/202 |
| 62-0183603 | 8/1987 | Japan . | |
| 2-0305201 | 12/1990 | Japan | 333/202 |
| 4-0044401 | 2/1992 | Japan | 333/206 |
| 0637896 | 12/1978 | U.S.S.R. | 333/206 |

*Primary Examiner*—Benny Lee

*Attorney, Agent, or Firm*—Ostrolenk, Faber, Gerb & Soffen, LLP

[57] ABSTRACT

A dielectric filter which includes a dielectric block having a plurality of through-holes defined therein so as to extend parallel to each other and spaced a predetermined distance from each other. Each of the through-holes has a peripheral wall lined with an electroconductive material to provide a respective hole electrode. This hole electrode has an isolation region dividing such hole electrode into two separate electrode components. The dielectric filter also has at least one terminal member provided within one of the through-holes and coupled through a dielectric element separate from the dielectric block.

21 Claims, 4 Drawing Sheets

Fig. 7
Prior Art
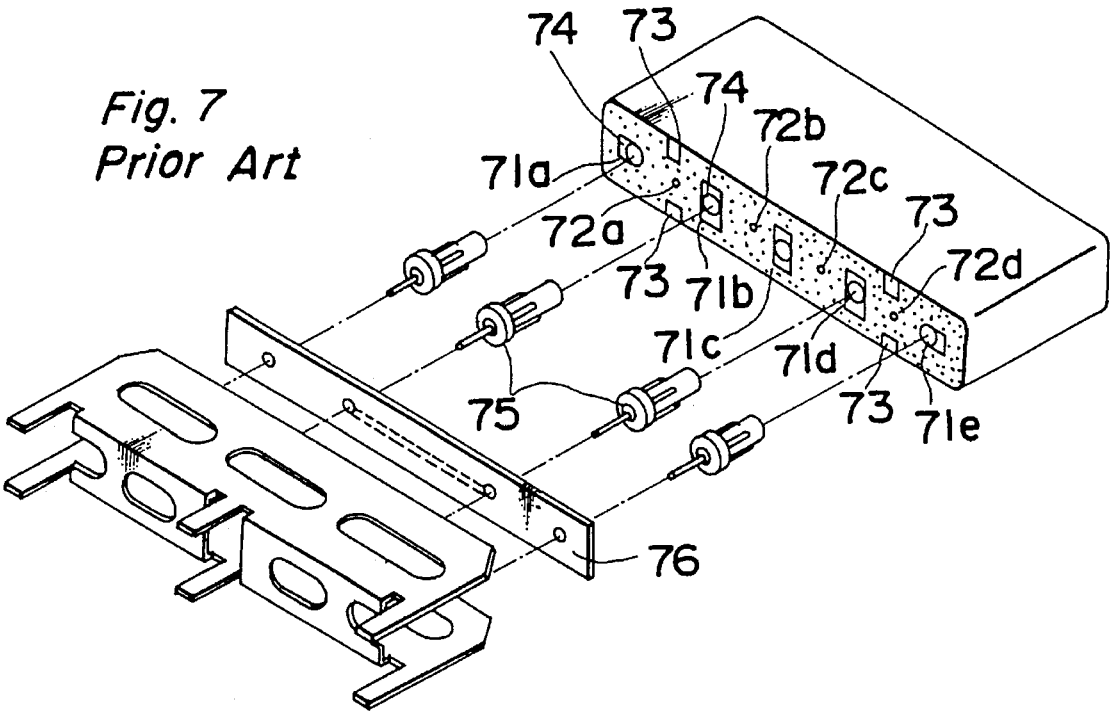
Fig. 8(a)
Prior Art
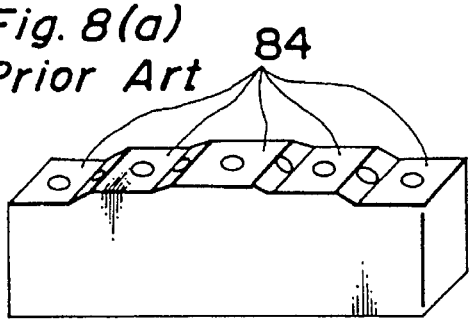
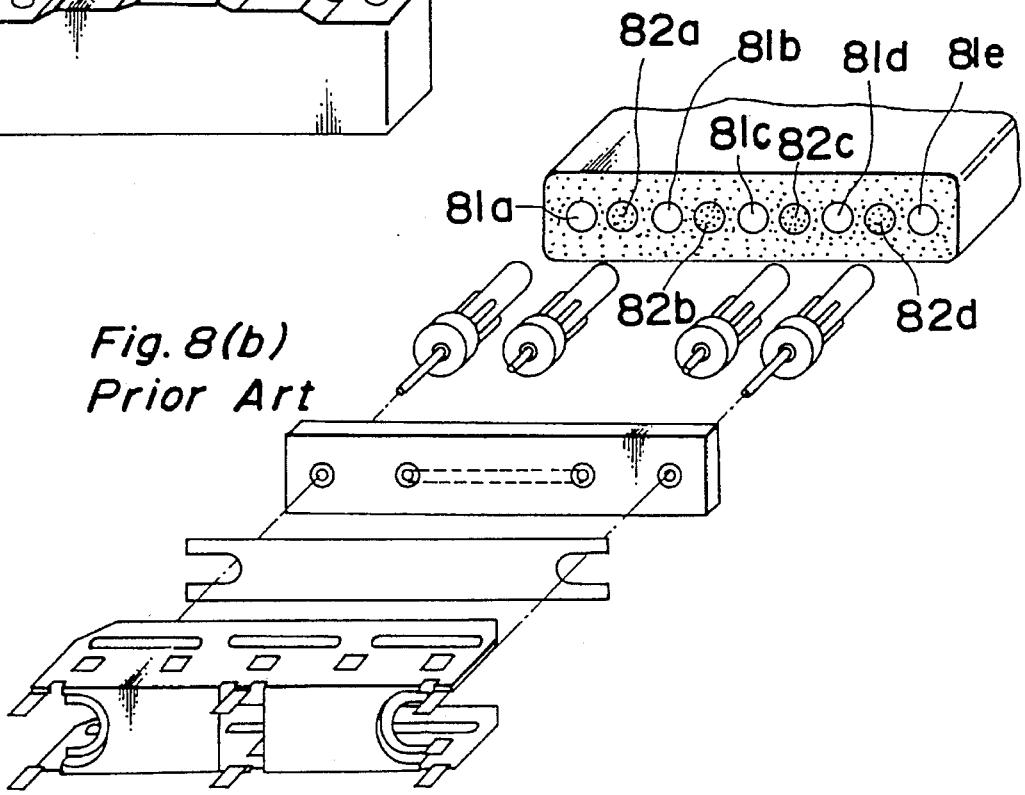
Fig. 8(b)
Prior Art

DIELECTRIC FILTER HAVING A NON-CONDUCTIVE REGION IN EACH RESONATOR HOLE

BACKGROUND OF THE INVENTION

1. Field of the Invention

The present invention relates to a dielectric filter of a type having first and second internally electroconductive holes defined therein in a juxtaposed fashion by depositing an electroconductive coating.

2. Description of the Prior Art

A prior art dielectric filter is shown in an exploded view in FIG. 6. The prior art dielectric filter shown in FIG. 6 comprises a generally parallelepiped block 61 of dielectric material, first and second coupling pins 62 and a metallic casing 63. The dielectric block 61 has first and second internally conductive holes 61*a* and 61*b* defined therein so as to extend parallel to each other and each having an internal surface lined with an electroconductive material, and also has a coupling hole 61*c* defined therein at a location intermediate between the first and second internally conductive holes 61*a* and 61*b*. In this dielectric filter, a coupling capacitance is defined between the coupling pins 62 and the internally conductive holes 61*a* and 61*b*.

Also, as shown in FIG. 7 in an exploded representation, in order to render the dielectric filter to have a polarity, internally conductive holes 71*a* and 71*b* have to be coupled with each other through a coupling hole 72*a*; internally conductive holes 71*b* and 71*c* have to be coupled with each other through a coupling hole 72*b*; internally conductive holes 71*c* and 71*d* have to be coupled with each other through a coupling hole 72*c*; and internally conductive holes 71*d* and 71*e* have to be coupled with each other through a coupling hole 72*d*. For the adjustment of each coupling degree, electroconductive patterns 73 are formed on a front surface of the dielectric block where the various holes 71*a* to 71*e* and 72*a* to 72*d* are opened towards the outside. The frequency of each resonator having the internally conductive holes 71*a* to 71*e* is adjusted by applying required electroconductive patterns 74 at the front surface of the dielectric block. The polarity of the dielectric filter can be obtained by forming a coupling capacitance exhibited by connecting the internally conductive holes 71*b* and 71*d* with each other through associated coupling pins 75 and an electrode conducting on a printed circuit board (PCB) 76. Alternatively, it is also known that, as is the case with the dielectric filter shown in FIGS. 8(*a*) and 8(*b*), internally conductive holes 81*a* and 81*b*, internally conductive holes 81*b* and 81*c* internally conductive holes 81*c* and 81*d*, and internally conductive holes 81*d* and 81*e* may be coupled with each other through respective coupling holes 82*a*, 82*b*, 82*c* and 82*d*, and individual resonators are designed to have a varying length defined by providing steps on a short-circuiting surface 84 so that each of the resonators can have a design resonance frequency.

In the prior art dielectric filters discussed above and shown in FIGS. 6, 7, 8(*a*), 8(*b*), since the coupling between each pair of neighboring resonators is determined by the coupling hole, the dielectric filter as a whole has a varying shape for each type, that is, each resonance frequency and/or each bandwidth and, therefore, the use of different molds is required for each type of the dielectric filters. In terms of manufacture, the presence of the coupling holes which are non-plated areas makes it difficult to mass-produce electrodes by the use of an electroless plating technique. Due to the problem associated with the mass-productivity, the prior art dielectric filter are disadvantageous in terms of cost. Also, due to the presence of the coupling holes, the dielectric block used in any of the prior art dielectric filters tends to become bulky and this is in contradiction to the demands for miniaturization of the dielectric filter.

SUMMARY OF THE INVENTION

The present invention has been devised to alleviate the above discussed problems inherent in the prior art dielectric filters and is intended to provide an improved dielectric filter of a type which is compact in size and which can be mass-produced at reduced costs while exhibiting an improved filtering characteristic and a favorable shield property.

To this end, the dielectric filter according to the present invention comprises a dielectric block having a plurality of through-holes defined therein so as to extend parallel to each other and spaced a predetermined distance from each other. Each through-holes has a peripheral wall lined with an electroconductive material to provide a respective hole electrode. This hole electrode has an isolation region dividing such hole electrode into two separate electrode components which are electrically connected with an electroconductive layer formed on an entire surface of the dielectric block. The dielectric filter also comprises at least one terminal member provided within one of the through-holes and coupled through a dielectric element separate from the dielectric block.

According to the present invention, due to the presence of a stray capacitance defined by each of the isolation regions in the hole electrodes, resonators having the respective through-holes can be coupled with each other. Moreover, the employment of the isolation regions eliminates the need to use coupling holes as required in the prior art dielectric filter, making it possible to manufacture the dielectric filter in a compact size and also to facilitate formation of both the internal and external conductors in the dielectric filter. Therefore, the present invention is effective to provide an inexpensive dielectric filter which can be mass-produced.

Also, any possible leakage of an electric field in the dielectric filter is considerably suppressed, allowing the dielectric filter of the present invention to exhibit an improved filtering characteristic.

BRIEF DESCRIPTION OF THE DRAWINGS

This and other objects and features of the present invention will become clear from the following description of preferred embodiments thereof with reference to the accompanying drawings, in which like parts are designated by like reference numerals and in which:

FIG. 7 is an exploded view of another type of the prior art dielectric filter;

FIG. 8(*a*) is a perspective view of the dielectric block used in a further type of the prior art dielectric filter; and FIG. 8(*b*) is an exploded view of the prior art dielectric filter of a type using the dielectric block shown in FIG. 8(*a*).

DETAILED DESCRIPTION OF THE EMBODIMENTS

Figure 1:
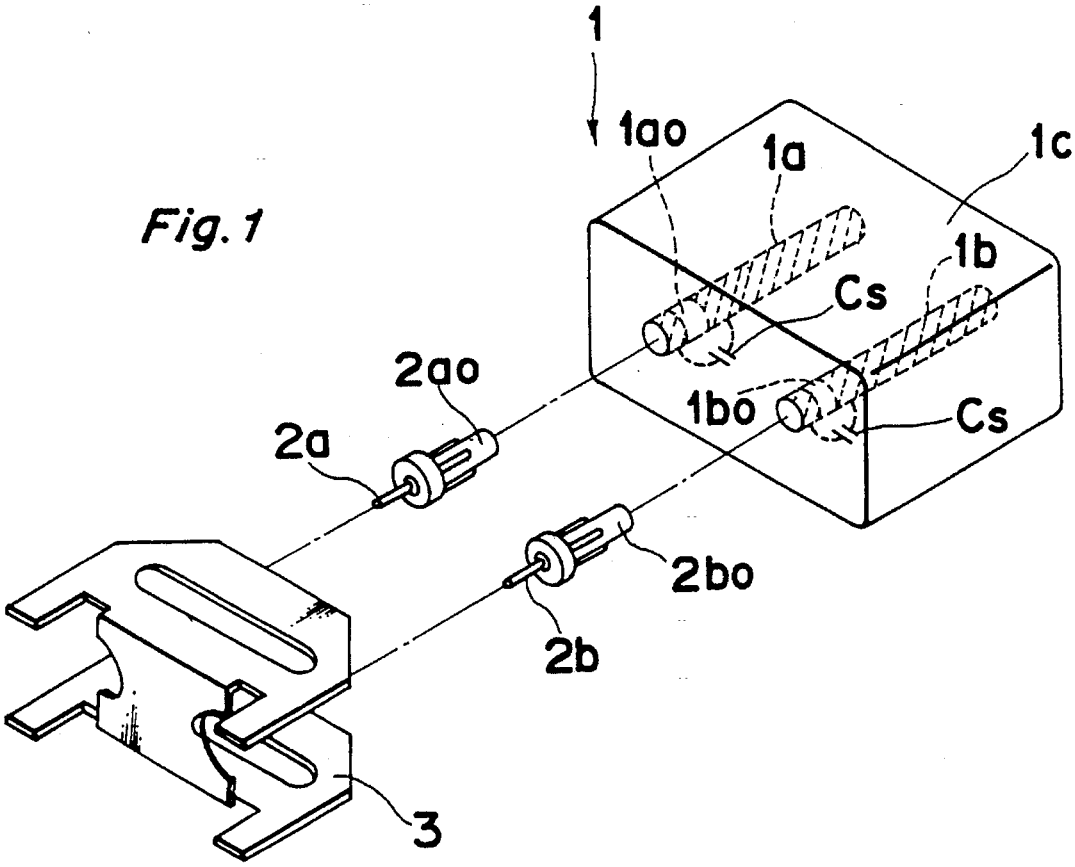
FIG. 1 is an exploded view of a dielectric filter according to a first preferred embodiment of the present invention.
Figure 2:
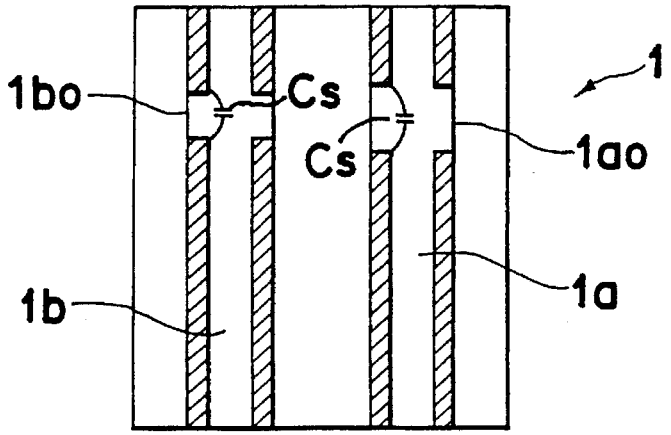
FIG. 2 is a transverse sectional view of a dielectric block used in the dielectric filter shown in FIG. 1.

Referring first to FIGS. 1 and 2, a dielectric filter according to a first preferred embodiment of the present invention shown therein comprises a dielectric block 1 of a generally parallelepiped configuration having generally rectangular front and rear surfaces opposite to each other, a pair of coupling pins 2 and a metallic casing 3. The dielectric block 1 has first and second internally conductive through-holes 1*a* and 1*b* of a predetermined diameter defined therein so as to extend parallel to each other and spaced a required distance from each other, each of said through-holes 1*a* and 1*b* having its opposite ends opening on the front and rear surfaces of the dielectric block 1.

Each of the through-holes 1*a* and 1*b* has a peripheral wall surface lined with an electroconductive material such as, for example, gold, silver or copper to define a respective hole electrode. On the other hand, the illustrated dielectric block 1 has six surfaces including the front and rear surfaces referred to above, all of said six surfaces deposited with an electroconductive material such as, for example, gold, silver or copper to provide an external conductor or electrode 1*c*.

The hole electrodes inside the respective internally conductive through-holes 1*a* and 1*b* cooperate with the external conductor 1*c* to define two resonators. Accordingly, an electroless plating can easily be effected to the six surfaces of the dielectric body 1 and the peripheral wall surfaces defining the through-holes 1*a* and 1*b* to form the respective electrodes, i.e., the hole electrodes and the external electrode 1*c*, thereby making it possible to mass-produce the dielectric filters.

The hole electrode inside each of the through-holes 1*a* and 1*b* is partially removed at a location generally intermediate of the length of the respective through-hole to define a circumferentially extending isolation region 1*ao* or 1*bo* by which the respective hole electrode is divided into two electrode components. The resonators are coupled with each other by means of stray capacitances Cs exhibited by the respective isolation regions 1*ao* and 1*bo*.

The coupling pins 2*a* and 2*b* are coaxially inserted into the respective through-holes 1*a* and 1*b* through associated inserts 2*ao* and 2*bo* each made of synthetic resin, so that respective coupling capacitances can be formed between the coupling pins 2*a* and 2*b* and the hole electrodes inside the through-holes 1*a* and 1*b*.

The metallic casing 3 is mounted on the dielectric block 1 so as to fit over the front surface thereof with the coupling pins 2*a* and 2*b* exposed to the outside.

According to the first preferred embodiment of the present invention shown in and described with reference to FIGS. 1 and 2, the presence of the isolation regions 1*ao* and 1*bo* in the hole electrodes inside the through-holes 1*a* and 1*b* eliminates the need to use the coupling hole which has hitherto been required in the prior art dielectric filter, and therefore the dielectric filter of the present invention can be made compact in size by a volume corresponding to that occupied by the coupling hole in the prior art dielectric filter.

The details of each of the isolation regions 1*ao* and 1*bo* defined inside the respective through-holes 1*a* and 1*b* will now be described with particular reference to FIG. 2 which illustrates a transverse sectional view of the dielectric block 1. Formation of each isolation region 1*ao* or 1*bo* is effected after the respective through-hole 1*a* or 1*b* has been electrolessly plated to form the hole electrode. Each isolation region 1*ao* or 1*bo* can readily be formed in any suitable manner, for example, by cutting or grinding that portion of the hole electrode inside the respective through-hole 1*a* or 1*b* where the isolation region is desired.

The position and the width of the isolation region 1*ao* or 1*bo* inside the respective through-hole 1*a* or 1*b* are determinative of the associated stray capacitance Cs and hence determinative of the coefficient of coupling between the resonators. It is to be noted that, since in the dielectric filter of the present invention an electric field within the dielectric block 1 leaks only through the isolation regions 1*ao* and 1*bo*, the dielectric filter of the present invention exhibits an excellent shield property as compared with the prior art dielectric filter utilizing the coupling hole.

Where a suitable block of, for example, ceramics having the internally conductive through-holes 1*a* and 1*b* defined therein so as to have a predetermined diameter and a predetermined distance of spacing therebetween, both of which are determined in consideration of the bandwidth, is molded into the parallelepiped configuration by the use of a mold so as to have a substantial length from the front surface to the rear surface and is subsequently cut to provide the dielectric body 1 of a size required to permit it to exhibit a required resonance frequency, any change desired of the resonance frequency and/or the bandwidth can be accommodated by properly selecting the position and the width of one or both of the isolation regions 1*ao* and 1*bo* to adjust the respective stray capacitances Cs. Thus, it will readily be seen that one and the same mold can be employed to make dielectric filters of different filtering characteristics, making it possible to enhance the efficiency of manufacture and to reduce the cost of manufacture.

While the dielectric filter shown in and described with reference to FIGS. 1 and 2 is of a type utilizing two resonators, the number of the resonators may not be always limited to two such as shown, but may be more than two. Also, the size and the dielectric constant of the dielectric block 1 and those of any one of the coupling pins 2 are not limited to those shown and described.

Figure 3:
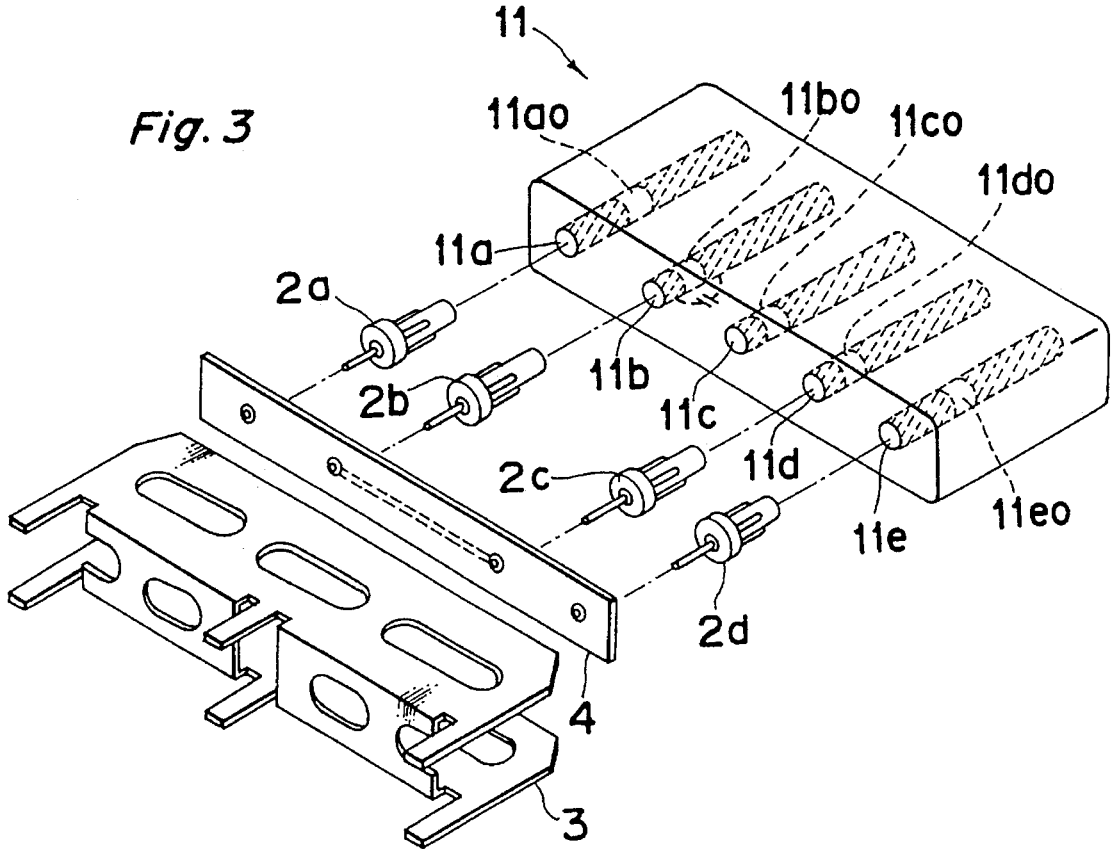
FIG. 3 is an exploded view of the dielectric filter according to a second preferred embodiment of the present invention.
Figure 4:
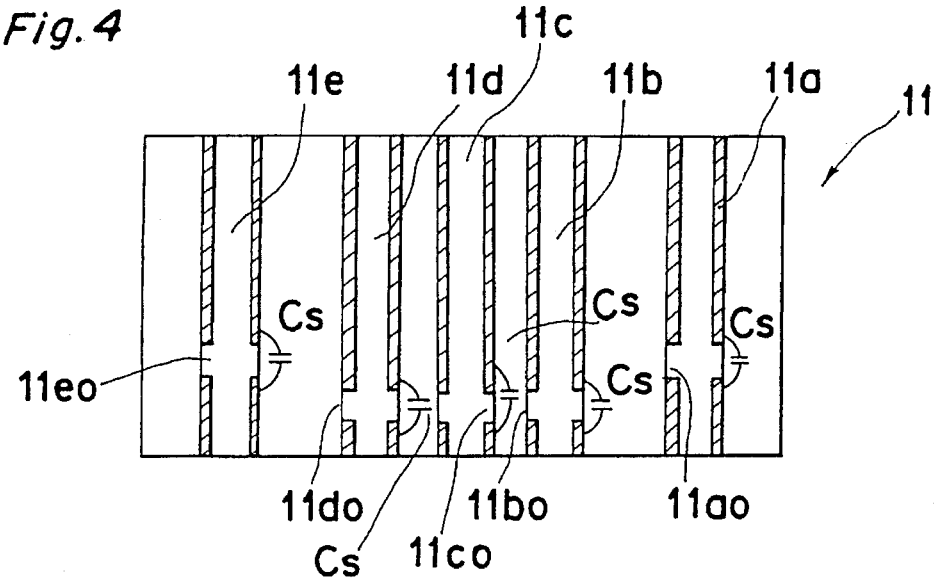
FIG. 4 is a transverse sectional view of a dielectric block used in the dielectric filter shown in FIG. 3.

A different embodiment of the dielectric filter of the present invention in which five resonators are employed is shown in FIGS. 3 and 4. Referring now to FIGS. 3 and 4, the dielectric filter shown therein comprises a dielectric block 11 of a generally parallelepiped configuration having generally rectangular front and rear surfaces opposite to each other, four coupling pins 2 and a metallic casing 3. The dielectric block 11 has first to fifth internally conductive through-holes 11*a* to 11*e* of a predetermined diameter defined therein so as to extend parallel to each other and spaced a required distance from each other, each of said through-holes 11*a* to 11*e* having its opposite ends opening on the front and rear surfaces of the dielectric block 11. Each of the through-holes 11*a* to 11*e* has a peripheral wall surface lined with an electroconductive material such as, for example, gold, silver or copper to define a respective hole electrode.

As is the case with the hole electrodes inside each of the internally conductive through-holes employed in the dielectric filter according to the foregoing embodiment of the present invention, the hole electrode inside each of the through-holes 11*a* to 11*e* is partially removed at a location generally intermediate of the length of the respective through-hole to define a circumferentially extending isolation region 11*ao* to 11*eo* by which the respective hole electrode is divided into two electrode components. The resonators are coupled with each other by means of stray capacitances Cs exhibited by the respective isolation regions 11*ao* to 11*eo*.

Again as is the case with the dielectric filter according to the foregoing embodiment, the coefficient of coupling between the resonators and the resonance frequency of each resonator can be adjusted by properly selecting the position and the width of the isolation regions 11*ao* to 11*eo*.

A printed circuit board 4 is used to connect coupling pins 2*b* and 2*c* together to define a capacitance coupling with which the dielectric filter can have a polarity.

Figure 5:
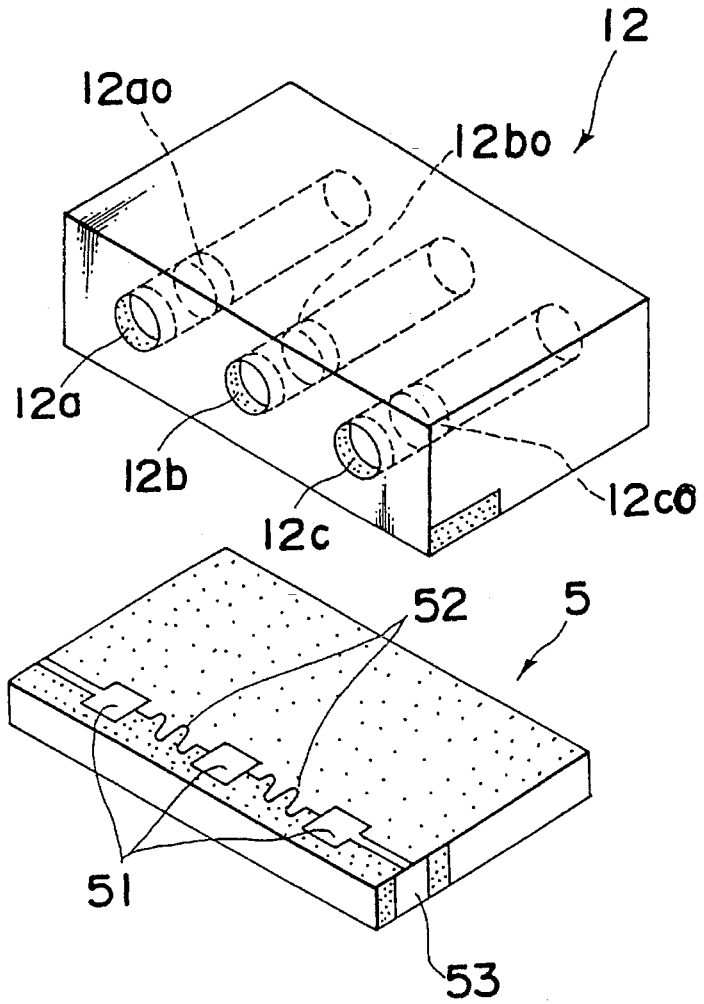
FIG. 5 is an exploded view of the dielectric filter of a comb-line coupling type.
Figure 6:
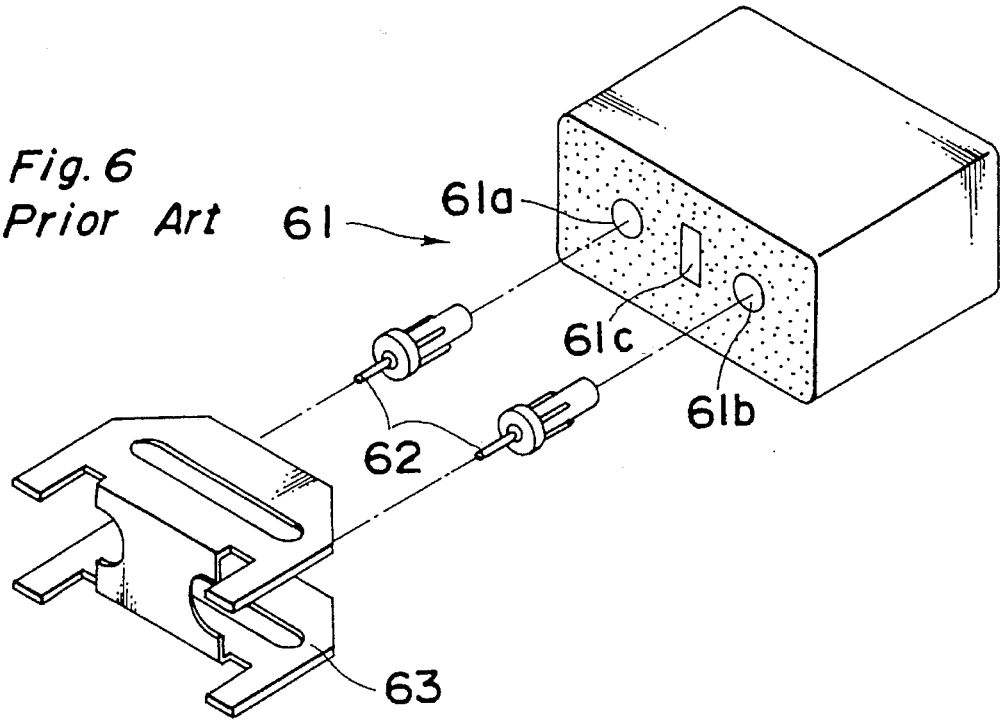
Fig. 6 Prior Art
FIG. 6 is an exploded view of one type of the prior art dielectric filter.

It is to be noted that, although in any one of the foregoing preferred embodiments of the present invention, the resonators are oriented in the same direction, the present invention can be equally applied to the type utilizing an interdigital coupling or a type employing a comb-line coupling that, as best shown in FIG. 5, utilizes a dielectric substrate for connection with the dielectric block.

Referring to FIG. 5, the dielectric filter having such a polarity as shown therein comprises a dielectric resonator 12 and a dielectric substrate 5 coupled with the dielectric resonator 12 to provide the dielectric filter. The dielectric resonator 12 has all surfaces, except for the surface thereof which confronts the dielectric substrate 5, lined with an electroconductive material and also has a plurality of, for example, three, internally conductive through-holes 12*a*, 12*b* and 12*c* defined therein, each of said through-holes 12*a* to 12*c* having a peripheral wall surface lined with an electroconductive material to provide a respective hole electrode. As is the case with any one of the foregoing embodiments of the present invention, each of the hole electrodes inside the through-holes 12*a* to 12*c* is formed with a circumferentially extending isolation region 12*ao*, 12*bo* or 12*co* through which the resonators are coupled while eliminating the need to use the coupling hole or holes hitherto required.

The dielectric substrate 5 has all surfaces, except for the surface thereof which confronts the dielectric resonator 12, lined with an electroconductive material. The surface of the dielectric substrate 5 facing the dielectric resonator 12 has patterned thereon capacitor electrodes 51 and inductor electrodes 52 each connecting the neighboring capacitor electrodes 51 together. In a condition in which the dielectric resonator 12 and the dielectric substrate 5 are coupled in face-to-face fashion with each other, the capacitor electrodes 51 are connected by capacitance coupling (comb line coupling) with the respective hole electrodes inside the through-holes 12*a* to 12*c*.

With the dielectric resonator 12 coupled with the dielectric substrate 5 in the manner described above, a pattern of the electrodes formed on that surface of the dielectric substrate 5 is conductive to an input/output electrode 53 which is formed by the use of, for example, a printing technique so as to extend therefrom to a portion of the surface of the dielectric substrate 5 which is opposite to that surface where the patterned electrodes are formed. This input/output electrode 53 is utilized for interfacing the patterned electrodes on the dielectric substrate 5 with an external electric circuit. Due to the presence of a part of the input/output electrode 53 on that opposite surface of the dielectric substrate 5, mounting of the dielectric filter according to the present invention onto the printed circuit board can be readily and assuredly accomplished.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A dielectric filter which comprises:

a dielectric block having an outer surface including a first surface and a second surface, and a plurality of through-holes defined in the dielectric block so as to extend from the first surface to the second surface generally parallel to each other and spaced a predetermined distance from each other, each through-hole having a respective peripheral wall lined with a corresponding lining of electroconductive material to provide a respective hole electrode, each said hole electrode having a respective isolation region, said respective isolation region being flush with said corresponding peripheral wall and comprising a region of said peripheral wall of each of said through-holes without said lining of electroconductive material, thereby dividing each said hole electrode into two separate electrode components, wherein each said hole electrode has one of said separate electrode components functioning as a quarter-wavelength resonator with an open end thereof at said isolation region and a short-circuit end thereof at said outer surface of said dielectric block;

said outer surface of the dielectric block being covered by an electroconductive material, said two separate electrode components of each said hole electrode being electrically connected with said electroconductive material on the outer surface of the dielectric block; and at least two terminal members for input and output, provided within respective ones of said plurality of through-holes and coupled to said corresponding hole electrodes through a respective dielectric element separate from the dielectric block.

2. The dielectric filter according to claim 1, wherein said dielectric block is of a generally parallelepiped shaped, said first and second surfaces are generally rectangular front and rear surfaces respectively opposite to each other, each of said through-holes having opposite ends thereof opening on the front and the rear surfaces of the dielectric block, respectively.

3. The dielectric filter according to claim 2, further comprising a metallic casing mounted on said dielectric block so as to fit over the front surface thereof, said at least two terminal members extending through said metallic casing so as to be exposed for connection to said dielectric block.

4. The dielectric filter according to claim 1, wherein said respective hole electrodes and said electroconductive material on the outer surface of the dielectric block each comprise electroless plated material.

5. The dielectric filter according to claim 1, wherein each said isolation region is a partially removed portion of said respective hole electrode located at a predetermined location along corresponding through-hole.

6. The dielectric filters according to claim 5, wherein each said isolation region extends circumferentially inside the corresponding through-hole.

7. The dielectric filter according to claim 1, wherein said two separate electrode components are resonators, said resonators being coupled with each other by means of stray capacitances exhibited by the respective isolation regions.

8. The dielectric filter according to claim 7, wherein a position and a width of each isolation region of the corresponding through-hole provide a predetermined stray capacitance.

9. The dielectric filter according to claim 1, wherein respective positions and widths of the corresponding isolation regions provide a predetermined value of at least one of a resonance frequency and a bandwidth of the dielectric filter.

10. The dielectric filter according to claim 1, wherein each said two seperate electrode components are unequal in length.

11. A dielectric filter which comprises:

a dielectric block having an outer surface including a first surface and a second surface, and a plurality of through-holes defined in the dielectric block so as to extend from the first surface to the second surface, each said through-hole having a respective peripheral wall lined with a corresponding lining of electroconductive material to provide a respective hole electrode, each said hole electrode having a respective isolation region, said isolation region being flush with said corresponding peripheral wall and comprising a region of said peripheral wall of each of said through-holes without said lining of electroconductive material, thereby dividing each said hole electrode into two separate electrode components, wherein each said hole electrode has one of said separate electrode components functioning as a quarter-wavelength resonator with an open end thereof at said isolation region and a short-circuit end thereof at said outer surface of said dielectric block;

electroconductive material provided on said outer surface of said dielectric block and said two separate electrode components of each said hole electrode being electrically connected with said electroconductive material on the outer surface of the dielectric block; and at least two terminal members for input and output, each terminal member coupled to a respective hole electrode inside a corresponding one of said plurality of through-holes.

12. The dielectric filter according to claim 11, wherein said at least two terminal members are provided within said corresponding through-holes, respectively, and are coupled to said respective hole electrodes through a corresponding dielectric element seperate from the dielectric block.

13. The dielectric filter according to claim 11, wherein said through-holes are arranged so as to extend generally parallel to each other and spaced a predetermined distance from each other.

14. The dielectric filter according to claim 11, wherein each said two seperate electrode components are unequal in length.

15. A dielectric filter comprising:

a dielectric block having an outer surface including a first surface and a second surface, and a plurality of through-holes defined in the dielectric block so as to extend from the first surface to the second surface generally parallel to each other and spaced a predetermined distance from each other;

each of said plurality of through-holes having a respective peripheral wall lined with a corresponding lining of electroconductive material to provide a respective hole electrode, each said hole electrode having a respective isolation region comprising a portion of said respective peripheral wall that is not lined with said corresponding electroconductive material so that said respective isolation region divides said corresponding hole electrode into two separate electrode components, wherein each said isolation region is located spaced from a midpoint of said dielectric block;

said outer surface of the dielectric block being covered by an electroconductive material, said two separate hole electrode components of each of said hole electrodes being electrically connected with said electroconductive material on the outer surface of the dielectric block; and at least two terminal members for input and output, provided within respective ones of said plurality of through-holes and coupled to said corresponding hole electrodes through a respective dielectric element separate from the dielectric block.

16. The dielectric filter according to claim 15, wherein said respective isolation region is located at a predetermined location along the corresponding through-hole.

17. The dielectric filter according to claim 15, wherein said respective hole electrodes and said electroconductive material on the outer surface of the dielectric block comprise electroless plating material.

18. The dielectric filter according to claim 15, further comprising a metallic casing mounted on said dielectric block so as to fit over the front surface thereof, said at least two terminal members extending through said metallic casing so as to be exposed for connection to the outside of said dielectric block.

19. The dielectric filter according to claim 15, wherein said two separate electrode components of each of said hole electrodes are unequal in length.

20. The dielectric filter according to claim 15, wherein said dielectric block has a generally parallelpiped shape, said first and second surfaces are generally rectangular front and rear surfaces disposed opposite to each other, each of said through holes having opposite ends opening on the front and the rear surfaces of the dielectric block, respectively.

21. A dielectric filter comprising:

a dielectric block having an outer surface including a first surface and a second surface, and a plurality of through-holes defined in the dielectric block so as to extend from the first surface to the second surface generally parallel to each other and spaced a predetermined distance from each other;

each of said plurality of through-holes having a respective peripheral wall lined with a corresponding lining of electroconductive material to provide a respective hole electrode, each said hole electrode having a respective isolation region comprising a portion of said respective peripheral wall that is not lined with said corresponding electroconductive material so that said respective isolation region divides said corresponding hole electrode into two separate electrode components, wherein each said two separate electrode components have unequal lengths;

said outer surface of the dielectric block being covered by an electroconductive material, said two separate hole electrode components of each of said hole electrodes being electrically connected with said electroconductive material on the outer surface of the dielectric block; and at least two terminal members for input and output, provided within respective ones of said plurality of through-holes and coupled to said corresponding hole electrodes through a respective dielectric element separate from the dielectric block.

* * * * *